US006206657B1

(12) United States Patent
Newcomer

(10) Patent No.: US 6,206,657 B1
(45) Date of Patent: Mar. 27, 2001

(54) AIR-OPERATED PUMPS WITH REMOVABLE CARTRIDGES FOR GROUNDWATER SAMPLING AND OTHER APPLICATIONS

(76) Inventor: Kevin L. Newcomer, 13734 Shady La., Monroe, MI (US) 48161

( * ) Notice: Subject to any disclaimer, the term of this patent is extended or adjusted under 35 U.S.C. 154(b) by 0 days.

(21) Appl. No.: 09/370,771

(22) Filed: Aug. 9, 1999

Related U.S. Application Data

(60) Provisional application No. 60/095,896, filed on Aug. 10, 1998, and provisional application No. 60/113,292, filed on Dec. 22, 1998.

(51) Int. Cl.[7] ..... F04B 43/10
(52) U.S. Cl. ..... 417/394
(58) Field of Search ..... 417/394, 395, 417/478, 479

(56) References Cited

U.S. PATENT DOCUMENTS

| | | | | |
|---|---|---|---|---|
| 2,564,198 | * | 8/1951 | Elkins | 73/152.18 |
| 3,113,455 | * | 12/1963 | Sloan et al. | 73/152.18 |
| 4,669,554 | | 6/1987 | Cordry | 175/59 |
| 4,717,473 | * | 1/1988 | Burge et al. | 210/170 |
| 4,943,210 | | 7/1990 | Bailey, Jr. et al. | 417/51 |
| 4,974,674 | | 12/1990 | Wells | 166/107 |
| 5,027,902 | * | 7/1991 | Dickinson | 166/369 |
| 5,099,920 | | 3/1992 | Warburton et al. | 166/250 |
| 5,293,934 | * | 3/1994 | Burge | 166/202 |
| 5,708,220 | * | 1/1998 | Burge | 73/864.34 |

* cited by examiner

*Primary Examiner*—Teresa Walberg
*Assistant Examiner*—Vinod D Patel
(74) *Attorney, Agent, or Firm*—Gifford, Krass, Groh, Sprinkle, Anderson & Citkowski, PC

(57) ABSTRACT

A pump of the type used for groundwater sampling, including the removal of gasoline or other hazardous materials, utilizes a cartridge which, in the preferred embodiment, is easily removable for bailing and other operations. The cartridge may be in the form of a flexible-walled bottle or other device, including a corrugated bellows, thereby providing a number of advantages over conventional designs, including the potential for truly automatic operation and higher throughput. The open end of the bellows or other collection device according to the invention is also preferably positioned with the open end oriented upwardly during normal operation, thereby allowing trapped gas to escape. Air-supply and fluid-discharge lines are coupled to the pump body through a pump head from an above-ground location. If removable, the bellows or other fluid collection device is fastened to the pump head within a shell which is removably attached to the pump head. The fluid-collection cartridge may be connected to the pump head through a threaded fitting, a press fitting, or other means providing an appropriate seal to the surrounding environment. In any case, cartridge is operable through pressurization be the air-supply line between a refill state, wherein fluid is drawn into the pump body through the fluid inlet, and a discharge state wherein fluid is forced out of the pump body through the discharge line.

12 Claims, 8 Drawing Sheets

(REFILL MODE)

(DISCHARGE MODE)

(REFILL MODE)

(REFILL MODE)

(REFILL MODE)

AIR-OPERATED PUMPS WITH REMOVABLE CARTRIDGES FOR GROUNDWATER SAMPLING AND OTHER APPLICATIONS

REFERENCE TO RELATED APPLICATIONS

This application claims priority of U.S. provisional patent applications Ser. Nos. 60/095,896, filed Aug. 10, 1998, and 60/113,292, filed Dec. 22, 1998, the entire contents of both of which are incorporated herein by reference.

FIELD OF THE INVENTION

This invention relates generally to pumps for groundwater sampling and the like, and, more particularly, to automated air-operated bellows pumps for groundwater sampling and other applications.

BACKGROUND OF THE INVENTION

There does exist many types of submersible pumps for groundwater sampling and other uses. FIG. 1 shows, generally at 100, a typical prior-art configuration. Since devices of this kind are inserted down well holes, the unit consists of an outer cylindrical pump body 102, typically constructed of stainless steel. The body includes a lower inlet end 104 and an upper outlet end 106. An internal cylindrical bladder 108, typically constructed of Teflon, partitions the interior of the pump body 102 into a gas-carrying section 110, and a fluid-carrying section 112 within the bladder 108.

A tube 114 having, perforations 116, is generally positioned within the fluid-carrying section 112, as shown. A lower check valve 120 is provided at the lower inlet end 104 to permit groundwater or like fluids to pass through the lower end 104 and into the tube 114 and fluid-carrying chamber 112 through perforations 116. The check valve 120 also prevents the fluid from backflowing through the lower inlet 104. An upper check valve 122 allows fluid from the fluid-carrying chamber 112 to be discharged through the upper end 106 by passing through apertures 116 and into the tube 114. The upper check valve 122 also prevents the fluid from backflowing down into the pump interior.

Above ground, a controller 130 is provided having a conduit 132 in pneumatic communication with the gas-carrying section 110 within the pump body 102. The apparatus operates by pressurizing and venting the gas within the chamber 110, thereby compressing and expanding the bladder 108, which is quite flexible, thereby forcing fluid within the chamber 112 out the upper end 106 through tube 114 by way of apertures 116. More particularly, when the pump body is submerged, ground water or other fluid flows into the chamber 112 through tube 114 having apertures 116 through the lower end 104, bypassing check valve 120 due to natural hydrostatic pressure.

When an actuating gas such as compressed air is driven through conduit 132 and into the gas-carrying section 110, the bladder 108 is compressed and the lower check valve 120 is forced against the opening 104, thereby forcing the fluid contained within the fluid-carrying section upwardly and out through the upper opening 106, displacing check valve 122 in its path. The gas-carrying chamber 110 is then vented at ground level through controller 130, permitting a fresh charge of ground water to again fill the fluid-carrying chamber 112 and tube 114 through perforations 116, at which time another cycle may be started by compressing the bladder 108.

Although a single controller 130 may be configured to control a multiplicity of similar pumps, the timing sequences for each pump must be optimized and stored to ensure the most efficient operation for each sampling station. The timing/cycling means within the controller therefore typically includes a 3-way valve associated with each pump to which it is connected. The 3-way valve is alternatively actuated and de-actuated to produce a pulsating flow to the bladder of each pump, wherein a compressed gas is applied via each conduit 132, on which the 3-way valve changes state, enabling the gas contained within chamber 110 to be vented to atmosphere. The controller 130 must therefore include electronic, pneumatic or mechanical timing devices associated with each 3-way valve, in each pump, to ensure proper operation thereof.

Pumps of the type just described are used in a variety of applications, including the continuous collection of gasoline and other hazardous materials from aquifers, as well as occasional groundwater sampling. There is also a need for pumps used for more infrequent sampling, using a device sometimes referred to as a "bailor." Originally, such devices assumed the form of a polyethylene or Teflon tube having a bottom end with a check ball. The device was lowered into a well, allowing liquid to trickle past the check ball until the tube was filled and the check ball was seated. The device was then removed form the well, the sample removed, and the rest of the device discarded.

By EPA mandate, the bailing process must remove three times the volume of a well before a sample is taken. This means that if the volume of the well is 50 gallons, 150 bailing operations must be taken prior to taking the actual sample. The time-consuming nature of this process led to the development of continuously cycling sampling pumps of the type described with reference to FIG. 1. Even with these, however, the apparatus is expensive, and the bladder must be removed, typically requiring a meticulous dismantling of the pump body. The need therefore remains for an economical pump capable of repetitive sampling. Ideally, such a pump would include some form of collection cartridge that is easily removable, allowing the pump to be used for more infrequent sampling applications, including bailing.

SUMMARY OF THE INVENTION

The present invention improves upon pumps of the type used for groundwater sampling, including the removal of gasoline or other hazardous materials, by providing a cartridge which, in the preferred embodiment, is easily removable for bailing and other operations. The invention also preferably utilizes a bellows as opposed to the traditional bladder used for fluid collection, thereby providing a number of advantages over conventional designs, including the potential for truly automatic operation and higher throughput. Although the drawings and associated descriptions refer to a corrugated bellows, it will be apparent to one of skill in the art that other types of bellows, including convoluted arrangements, may alternatively be utilized. The open end of the bellows or other collection device according to the invention is also preferably positioned with the open end oriented upwardly during normal operation, thereby allowing trapped gas to escape.

An air-operated pump for groundwater sampling and other applications according to the invention includes a submersible pump body having a fluid inlet. Air-supply line and fluid-discharge lines are coupled to the pump body from an above-ground location, and a corrugated bellows or alternative collection cartridge is disposed within the pump body. The fluid-collection device features a closed end and an open end which is preferably oriented upwardly to allow trapped gas to escape. The bellows or alternative collection device is operable through pressurization be the air-supply line between a refill state, wherein fluid is drawn into the pump body through the fluid inlet, and a discharge state wherein fluid is forced out of the pump body through the discharge line.

In the preferred embodiment, the pump further includes a pump head having a lower, fluid-receiving port, and a shell removably attachable to the pump head. The bellows or alternative fluid-receiving device is disposed within the shell and removable attachable to the fluid-receiving port on the pump head. The fluid-collection cartridge may be removably attachable to the pump head through a threaded fitting, a press fitting, or other means providing an appropriate seal to the surrounding environment.

DETAILED DESCRIPTION OF THE INVENTION

According to one aspect, the present invention improves upon pumps of the type used for groundwater sampling, including the removal of gasoline or other hazardous materials, by providing a collapsible bellows as opposed to the traditional bladder used for fluid collection. The substitution of a bellows over a flexible bladder offers a number of advantages over conventional designs, including the potential for truly automatic operation; that is, continuous cycling without necessarily relying on an above-ground controller to precisely time out the charge and discharge portions of each cycle. According to a different aspect, the invention positions the bellows with the open end oriented upwardly during normal operation, thereby allowing trapped gas to escape. Given this orientation, in accordance with a preferred embodiment, the invention also provides a pump head manifold arrangement enabling the fluid-collection canister to be easily changed, thereby accommodating both long-term, continuous cycling or bailing-type applications. Before describing this particular embodiment of the invention, various alternative embodiments will first be described with reference to the figures.

Figure 1:
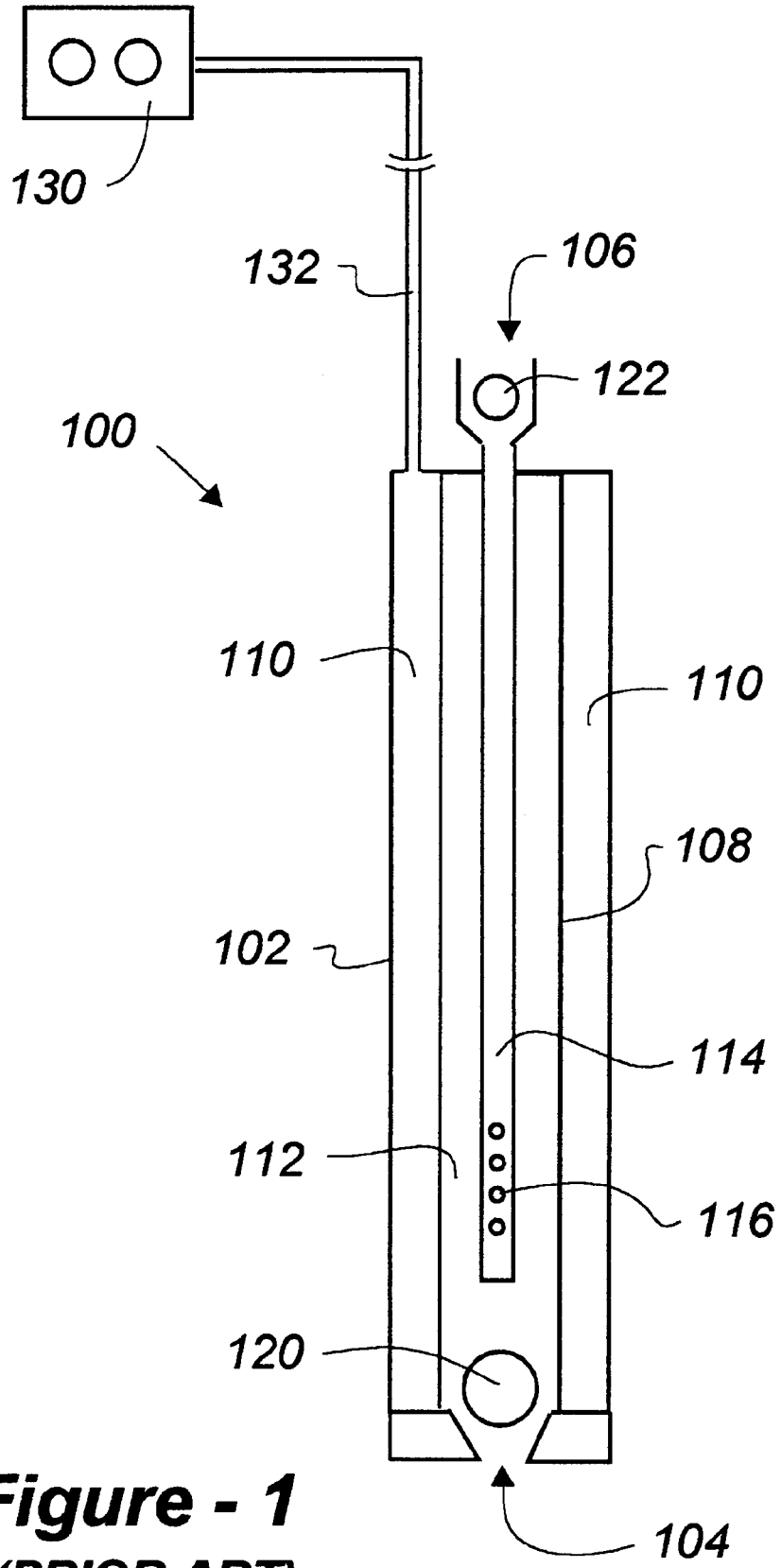
Figure - 1 (PRIOR ART)
FIG. 1 is a simplified drawing of a prior-art, air-operated ground water pump wherein a thin-walled bladder is alternatively compressed and vented to atmosphere.
Figure 2A:
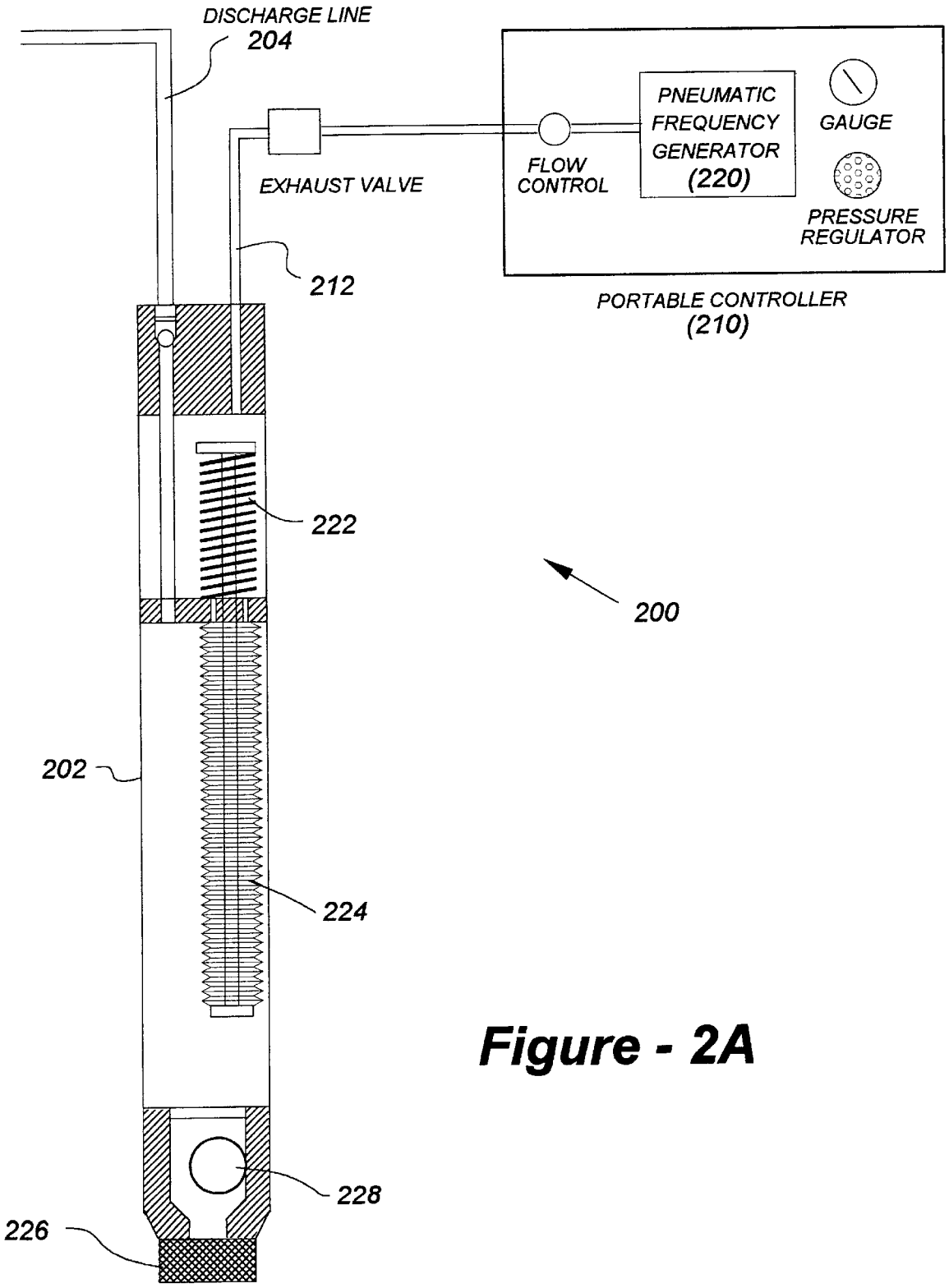
FIG. 2A is a drawing of a groundwater-sampling pump according to the invention having been interconnected to a portable controller and operating in a refill mode.

FIG. 2A illustrates a basic configuration generally at 200. The apparatus includes a submersible pump housed having a pump body 202 having a discharge line 204. The pump body is in communication with an above-ground controller 210 through an air-supply/exhaust line 212. The controller 210 includes means such as pneumatic frequency generator 220 for cycling between refill and discharge modes of operation. It will be appreciated by those of skill that the frequency generator may be replaced with any type of timer, back-pressure sensor, or other apparatus operative to ensure a regular cycling of the pump. In addition, with the addition of a sensing arrangement or separate exhaust line, the pump of FIG. 2A, as well as the other pump configurations disclosed herein, may be rendered semiautomatic or fully automatic, as described in co-pending U.S. patent application Ser. No. 09/370,771, the entire contents of which are incorporated herein by reference.

Figure 2B:
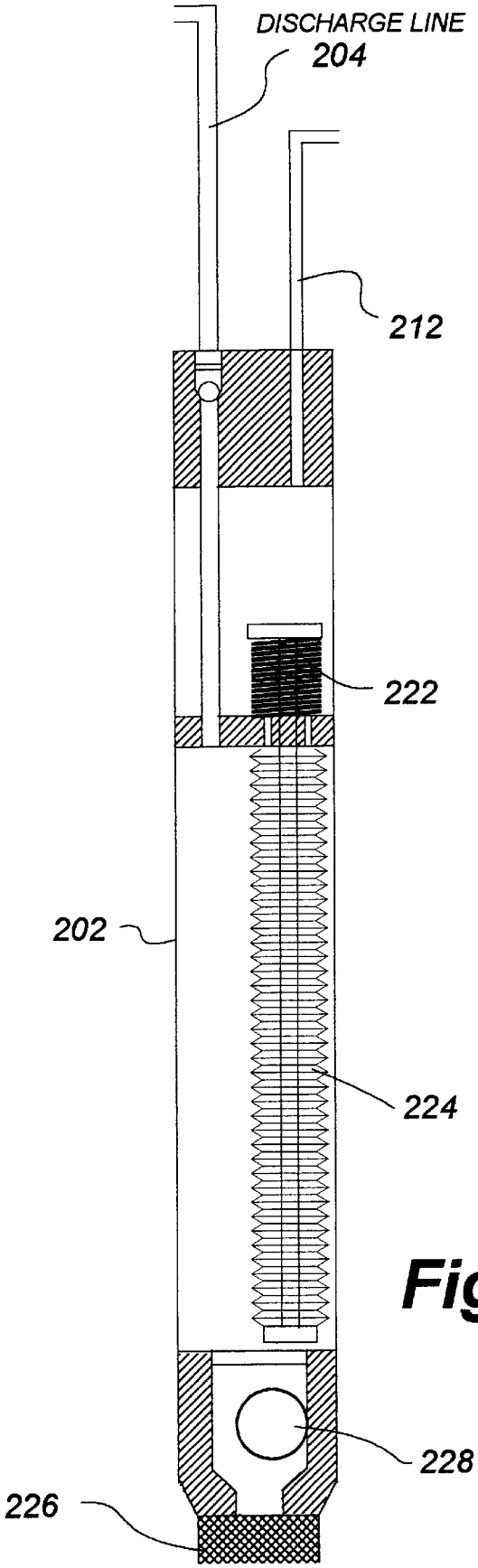
FIG. 2B shows the pump of FIG. 2A operating in a discharge mode.
Figures 2C, 2D:
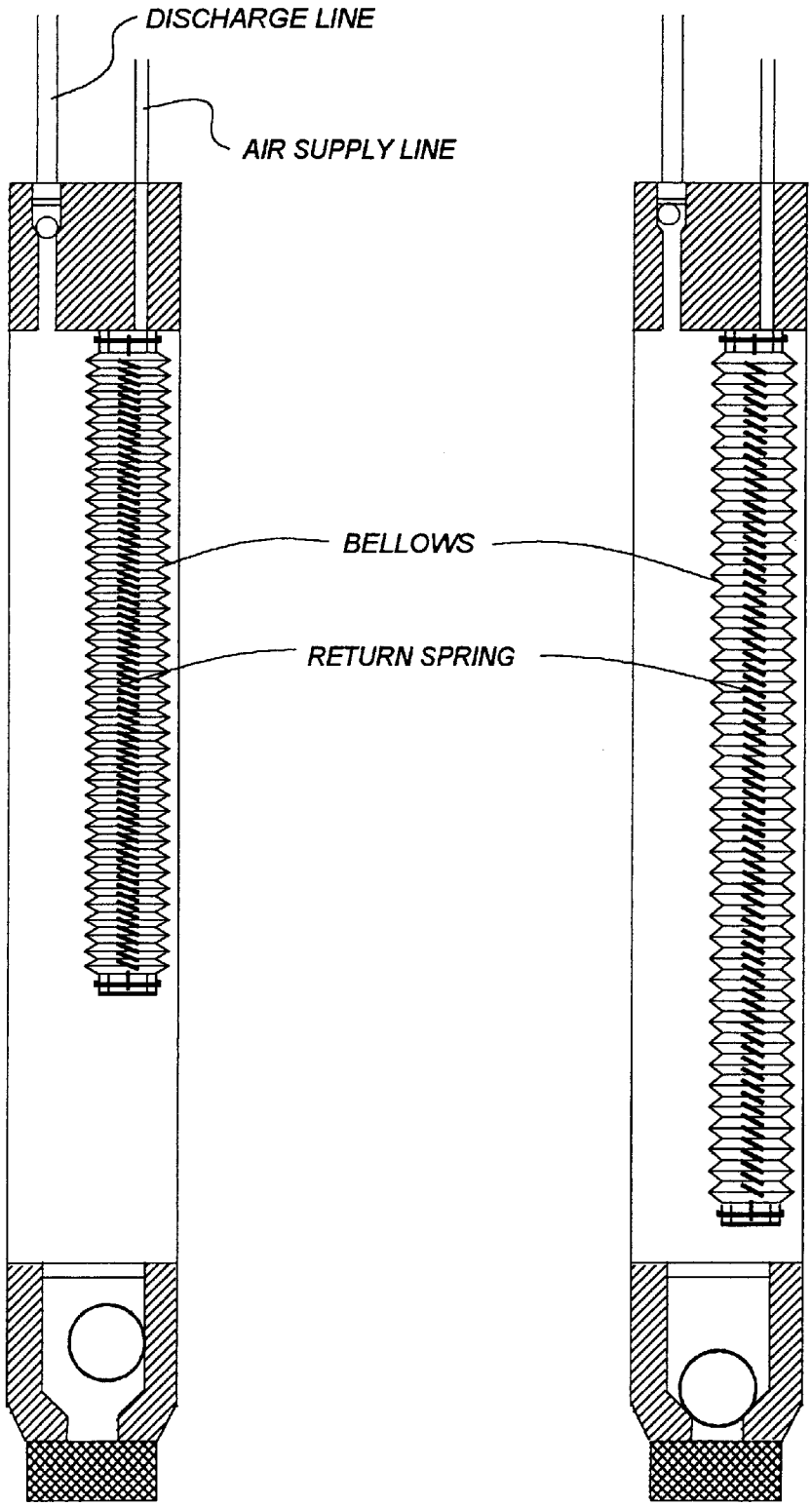
FIG. 2C is a drawing of an alternative embodiment of the invention wherein a return spring is disposed within the bellows, the device operating in a refill mode of operation.
FIG. 2D is a drawing of the pump of 2A operating in a discharge mode.

The pump of FIGS. 2A and 2B optionally features a return spring 222 which assists in compressing the bellows 224, thereby drawing a fresh charge of fluid into the pump body through the lower inlet 126 past check ball 128. Although the return spring 122 is shown externally of the bellows 124, the spring may alternatively be positioned within the bellows, as shown in FIGS. 2C and 2D, which depict refill and discharge modes of operation, respectively. Although checkballs are used in the preferred embodiments, it will be apparent to those of skill in the art that other types of repetitive seals may be used, such as flap valves, particularly if space requirements so dictate.

Figure 3:
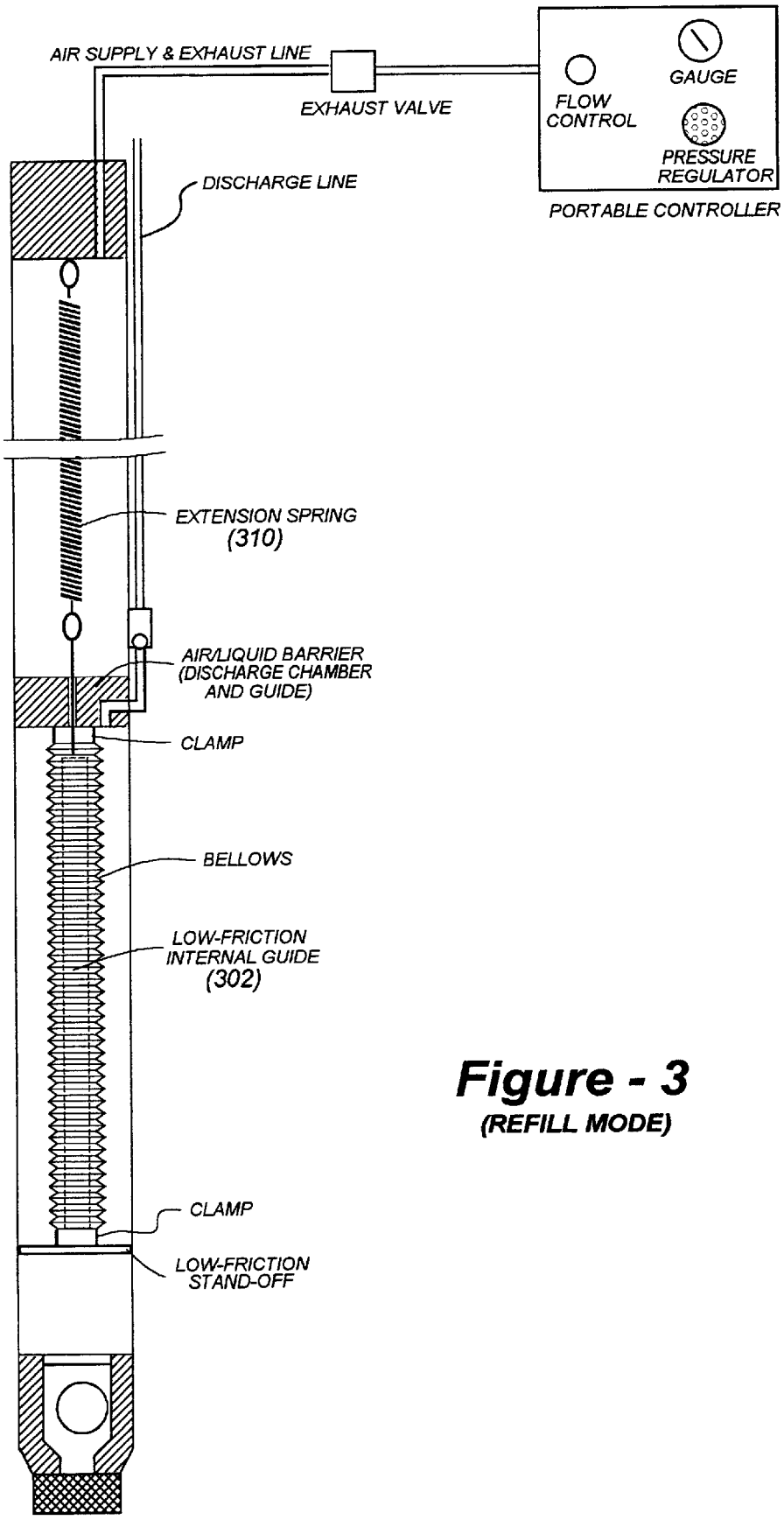
FIG. 3 is a drawing of a further alternative embodiment of the invention including an extension spring in an upper chamber.
Figure 4:
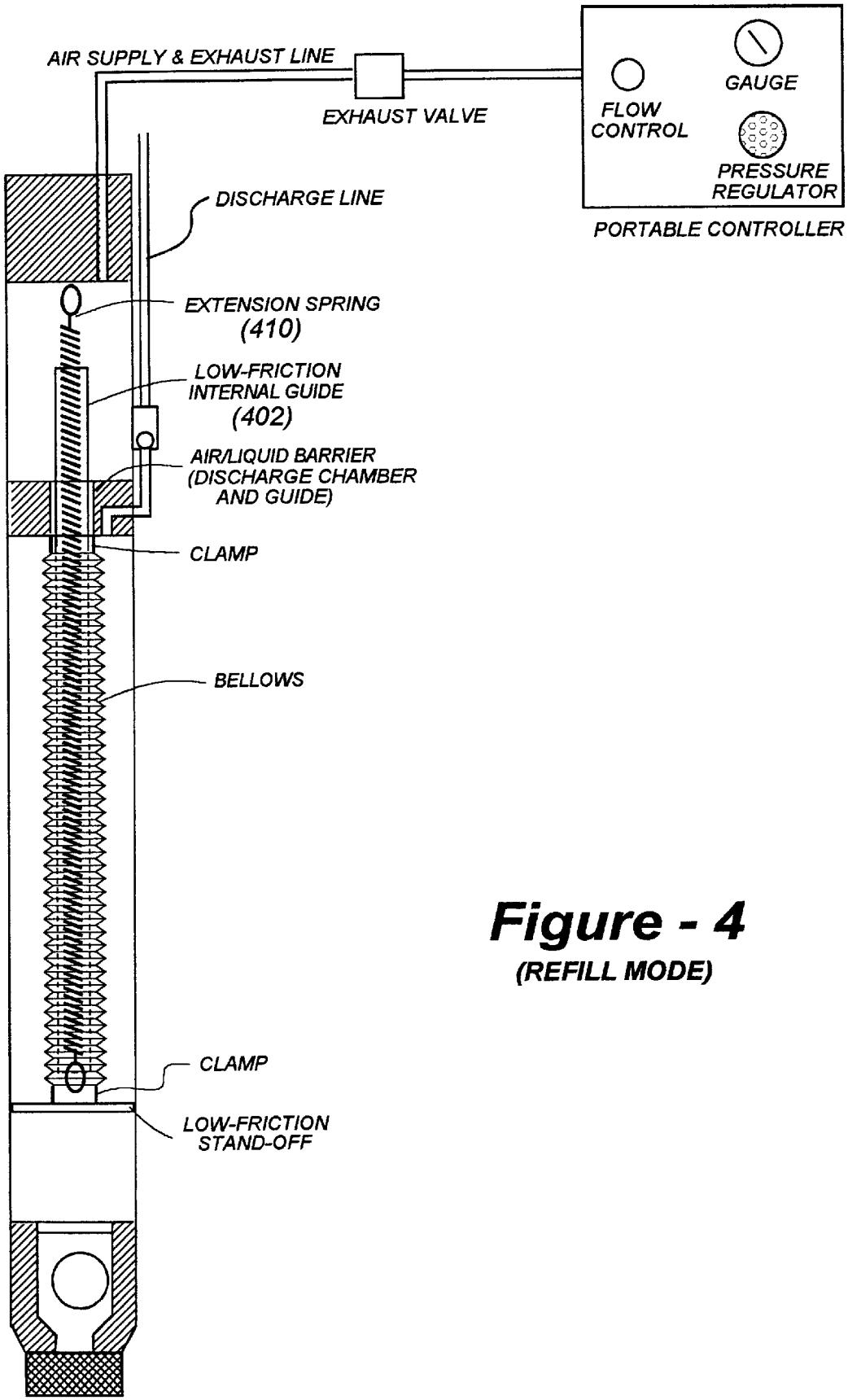
FIG. 4 is similar to FIG. 3, except that the extension spring is disposed within the bellows.

If a bellows is used in conjunction with any of the embodiments described herein, internal guides may employed to keep the bellows from excessive flexing. Guides of this type are shown in FIGS. 3 and 4 as elements 302 and 402, respectively, and may be constructed from any appropriate material, including Teflon, polished stainless steel, acetal glass, and so forth. The primary difference between the pump configurations of FIGS. 3 and 4 is that, in FIG. 3, the extension spring 310 is located externally of the bellows, whereas, in the case of FIG. 4, the extension spring 410 is at least partially within the body of the bellows. The guide may be solid, though a hollow tube may alternatively be used, particularly if a return spring is positioned internally to the bellows as in the case of FIG. 4. When positioned in this manner, the guide also serves to protect the bellows from coming in contact with the extension spring, which might cause premature wear.

Figure 5:
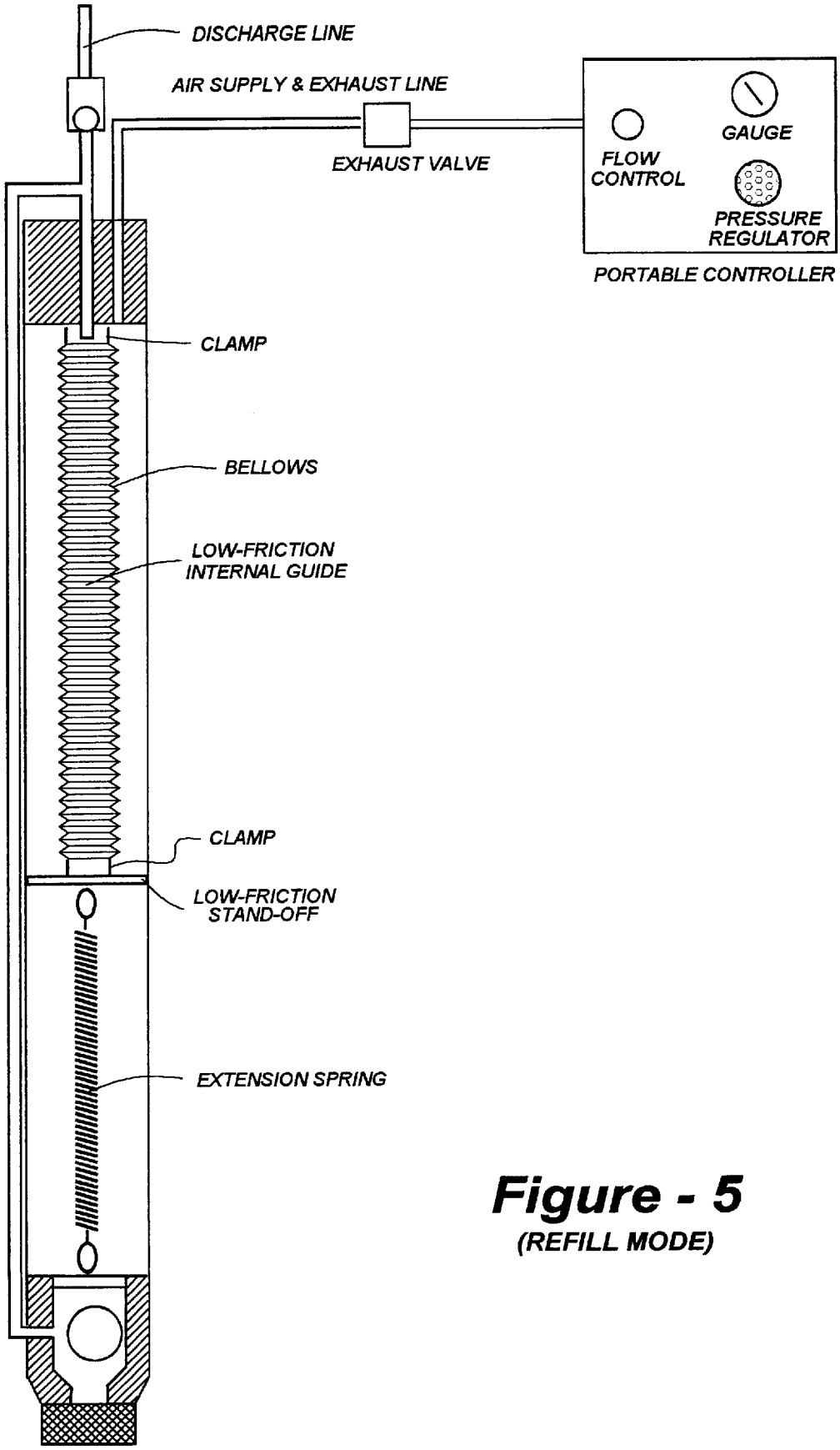
FIG. 5 is a drawing of yet a further alternative embodiment of the invention which allows air trapped within the bellows to escape during an initial start-of-sequence.

To permit air entrapped within the bellows to escape during the initial dry start-of-sequence, an extension spring may be positioned on the opposite side of the bellows, as shown in FIG. 5. In this configuration, when compressed air is supplied to the pump, the bellows compresses upwardly, seating the inlet checkball, discharging air, and allowing water to pass through the inlet screen and into the top of the bellows through the discharge check assembly. The compressed air is then exhausted, allowing the bellows to extend downwardly with the assistance of the extension spring. The upper checkball seats, and the inlet check unseats, allowing water to be drawn into the bellows. Although this configuration will function without an extension spring, the extent of the downward spring will be shortened, decreasing the volume pumped per stroke.

Figure 6:
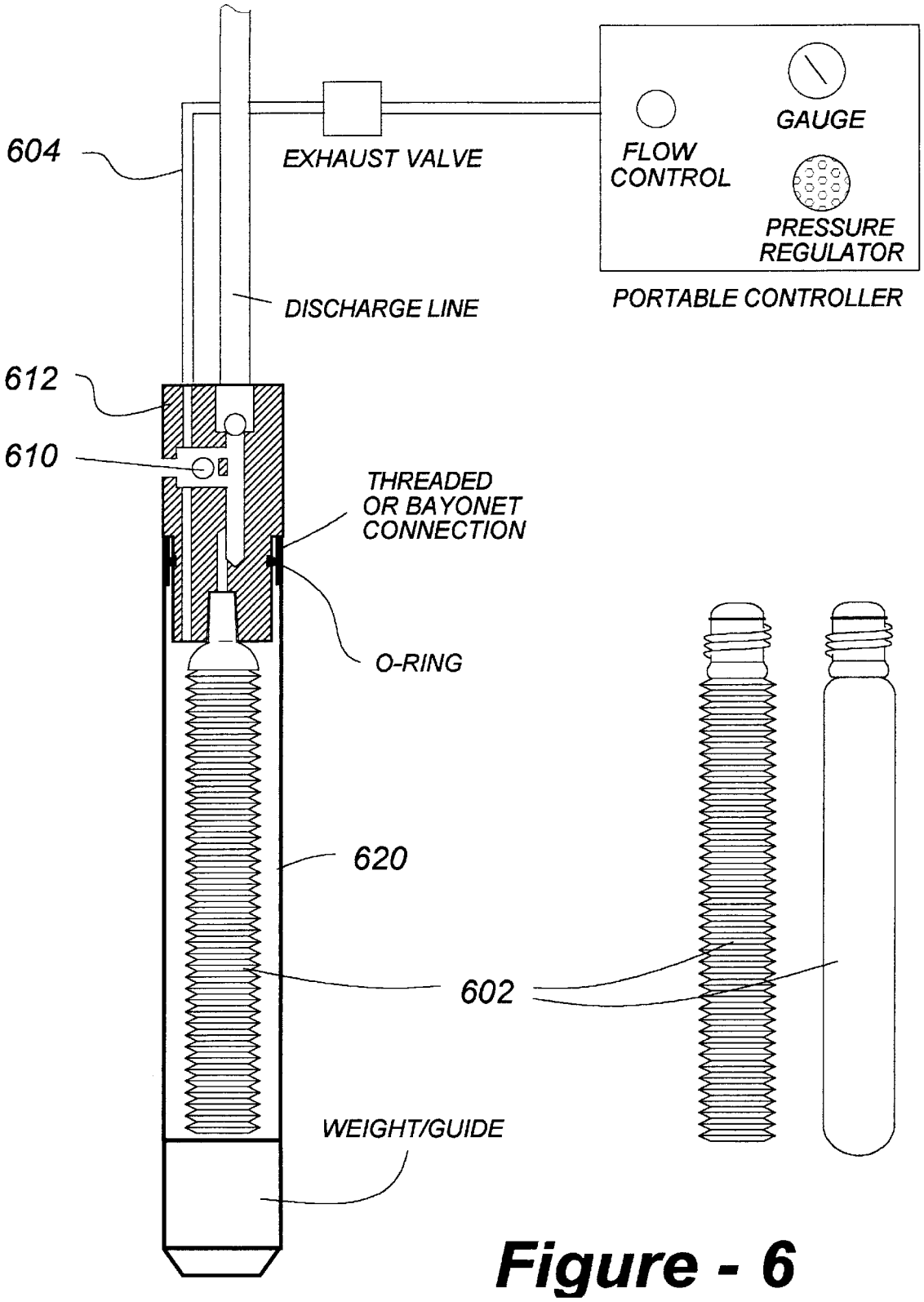
FIG. 6 is a drawing of a preferred embodiment of the invention having an easily changed fluid-collection canister.

FIG. 6 illustrates a preferred embodiment of the invention, wherein a bellows 602 or collapsible bottle may be easily changed and replaced with each sample taken, thereby decreasing the chances of sample cross-contamination. The bellows or bottle, once removed, may also be kept and sent directly to a lab for testing, thereby eliminating the need for glass sampling bottles as currently used.

The top portion of the removable cartridge may be provided with threads and an o-ring to screw in and seal to the bottom of the pump head or, alternatively, the cartridge may include a tapered-press fit, thereby eliminating the need for threads and o-rings. Of course, it will be appreciated by one of skill, that although this embodiment facilitates removability, the bellows or collapsible bottle may be dedicated and non-removable as well.

The pump configuration of FIG. 6 works similarly to the other embodiments described herein, with one exception being that the inlet 610 has been moved into the pumphead 612. The pump body 620 beneath the pump head 612 is now removable using a threaded or bayonet connection in combination with an o-ring seal. Although this results in a somewhat more complex manifold structure, it may be reused over a long period of time.

Having described my invention, I now claim:

1. An air-operated pump for groundwater sampling and other applications, comprising:

a submersible pump body having a fluid inlet;

an air-supply line and a fluid-discharge line, each coupled to the pump body from an above-ground location; a corrugated bellows disposed within the pump body, the bellows having a closed end and an open end that is oriented upwardly to allow trapped gas to escape, the bellows being operable between a refill state, wherein fluid is drawn into the pump body through the fluid inlet, and a discharge state wherein fluid is forced out of the pump body through the discharge line.

2. The pump of claim 1, wherein the bellows is compressed during the refill state and expanded during the discharge state.

3. The pump of claim 1, further including:

a pump head having a lower, fluid-receiving port;

a shell removably attachable to the pump head; and wherein the bellows is disposed within the shell and removable attachable to the fluid-receiving port on the pump head.

4. The pump of claim 3, wherein the bellows is removably attachable to the pump head through a threaded fitting.

5. The pump of claim 3, wherein the bellows is removably attachable to the pump head through a press fitting.

6. The pump of claim 3, wherein the fluid inlet is disposed on a sidewall of the pump head.

7. An air-operated pump for groundwater sampling and other applications, comprising:

a submersible pump body having an upper pump head and a lower shell removably attachable to the pump head;

an air-supply line, a fluid inlet, and a fluid-discharge line, each coupled to the pump body through the pump head; and a removable cartridge contained within the shell the cartridge having an upper end in fluid communication with the fluid inlet and fluid-discharge line, the pump being operable between a refill state, wherein fluid is drawn into the cartridge through the fluid inlet, and a discharge state, wherein fluid is expelled from the pump body through the discharge line.

8. The pump of claim 7, wherein the cartridge is compressed during the refill state and expanded during the discharge state.

9. The pump of claim 7, wherein the cartridge is a corrugated bellows.

10. The pump of claim 7, wherein the cartridge is a collapsible bottle.

11. The pump of claim 7, wherein the bellows is removably attachable to the pump head through a threaded fitting.

12. The pump of claim 7, wherein the bellows is removably attachable to the pump head through a press fitting.

* * * * *